United States Patent [19]

Wissman

[11] 4,396,239

[45] Aug. 2, 1983

[54] INTERLOCK MECHANISM

[75] Inventor: Tom Wissman, Largo, Fla.

[73] Assignee: Paradyne Corporation, Largo, Fla.

[21] Appl. No.: 242,224

[22] Filed: Mar. 10, 1981

[51] Int. Cl.[3] ..... E05C 15/04; E05C 7/06

[52] U.S. Cl. ..... 312/216; 312/217; 312/220; 312/221; 312/222

[58] Field of Search ..... 312/107, 111, 215, 216, 312/217, 220, 221, 222, 107.5

[56] References Cited

U.S. PATENT DOCUMENTS

| | | | |
|---|---|---|---|
| 497,406 | 5/1893 | Dubois et al. | 312/221 |
| 663,589 | 12/1900 | Smith | 312/220 |
| 2,368,859 | 2/1945 | Mayer | 312/222 |
| 2,842,419 | 7/1958 | Howard | 312/222 |
| 2,886,392 | 5/1959 | Stegmaier | 312/217 |
| 2,988,412 | 6/1961 | Vannice | 312/111 |
| 3,404,929 | 10/1968 | Wright et al. | 312/216 |
| 3,888,558 | 6/1975 | Himsl | 312/216 |
| 4,303,287 | 12/1981 | Taplin | 312/217 |

FOREIGN PATENT DOCUMENTS

| | | | |
|---|---|---|---|
| 974824 | 4/1961 | Fed. Rep. of Germany | 312/215 |

*Primary Examiner*—Victor N. Sakran

*Attorney, Agent, or Firm*—Kane, Dalsimer, Kane, Sullivan & Kurucz

[57] ABSTRACT

An interlock mechanism for use with a plurality of vertically stacked units such as disk drives wherein said mechanism allows only one unit to be withdrawn or extended from the stack at a time.

5 Claims, 5 Drawing Figures

FIG. 2
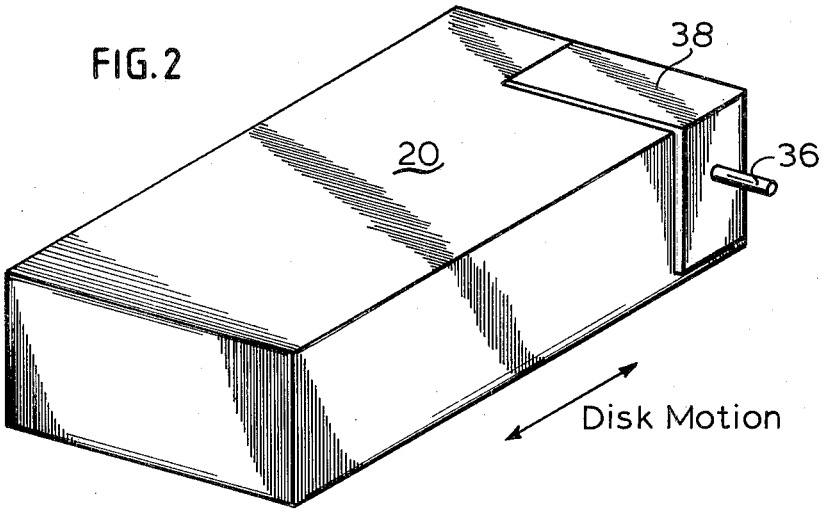
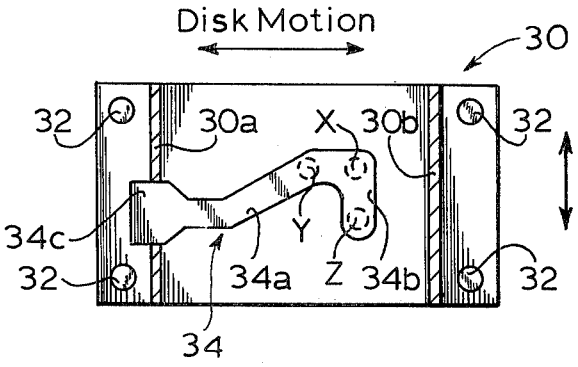
FIG. 3
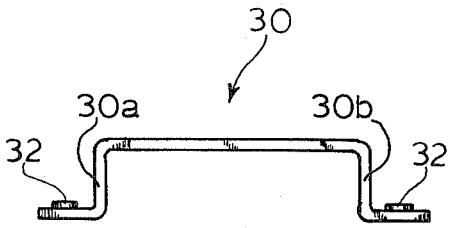
FIG. 4
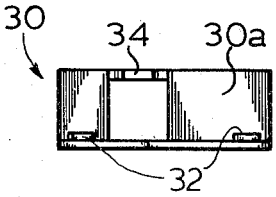
FIG. 5

INTERLOCK MECHANISM

FIELD OF THE INVENTION

The present invention is directed towards providing an interlock mechanism for a plurality of separate slide mounted units.

BACKGROUND OF THE INVENTION

There presently exist many situations which involve supporting a plurality of slide mounted units in a stacked arrangement where it is desirous in the trade to allow only a single unit at a time to be withdrawn or extended from the stack. An example of this involves the use of heavy slide mounted disk drives, typical in the computer industry, which are maintained usually in free standing, roll about cabinets. Often during their use, it is necessary to extend a disk drive from the cabinet for replacement or servicing etc. If a second disk drive is thereafter extended there exist the dangerous possibility that the cabinet may tip over due to the extension of the second as a result of a change in the center of gravity of the cabinet.

SUMMARY OF THE INVENTION

Accordingly, it is an object of the present invention to provide for an interlock mechanism which will not allow more than one unit to be extended after a unit has already been extended.

It is another object to provide for such a mechanism which is effective yet relatively inexpensive and of simple construction, and can satisfy the needs of the trade.

Other objects and advantages will become apparent from the present invention which provides for an interlock mechanism for use in conjunction with a plurality of stacked units maintained by a support, having a bearing member or a pin attached to the slidable unit, which upon extension from the support, engages a camming surface or slot in a capture bracket. This capture bracket is mounted on a vertical sliding member on which capture brackets for each of stacked units are also mounted, with their corresponding pins similarly disposed in their respective slots.

The pin engages the sides of curved slot upon extension from the support, cams the bracket and accordingly slide member vertically, which places the other units' pins in a locking position with respect to the capture bracket, preventing their extension from the support. When the extended unit is inserted back into the support, a reverse camming to the aforenoted occurs, which then allows any one of the units free to be extended.

BRIEF DESCRIPTION OF THE DRAWINGS

FIG. 2 is a perspective view of a disk drive having the pin portion of the interlocking mechanism mounted thereon;

FIG. 3 is a plan view of the capture bracket of the interlocking mechanism with the pin portion shown phantom in various positions therein;

FIG. 4 is a side elevational view of the capture bracket along its longitudinal axis;

FIG. 5 is a side elevational view of the capture bracket along its vertical axis.

DETAILED DESCRIPTION OF THE PREFERRED EMBODIMENT

Figure 1:
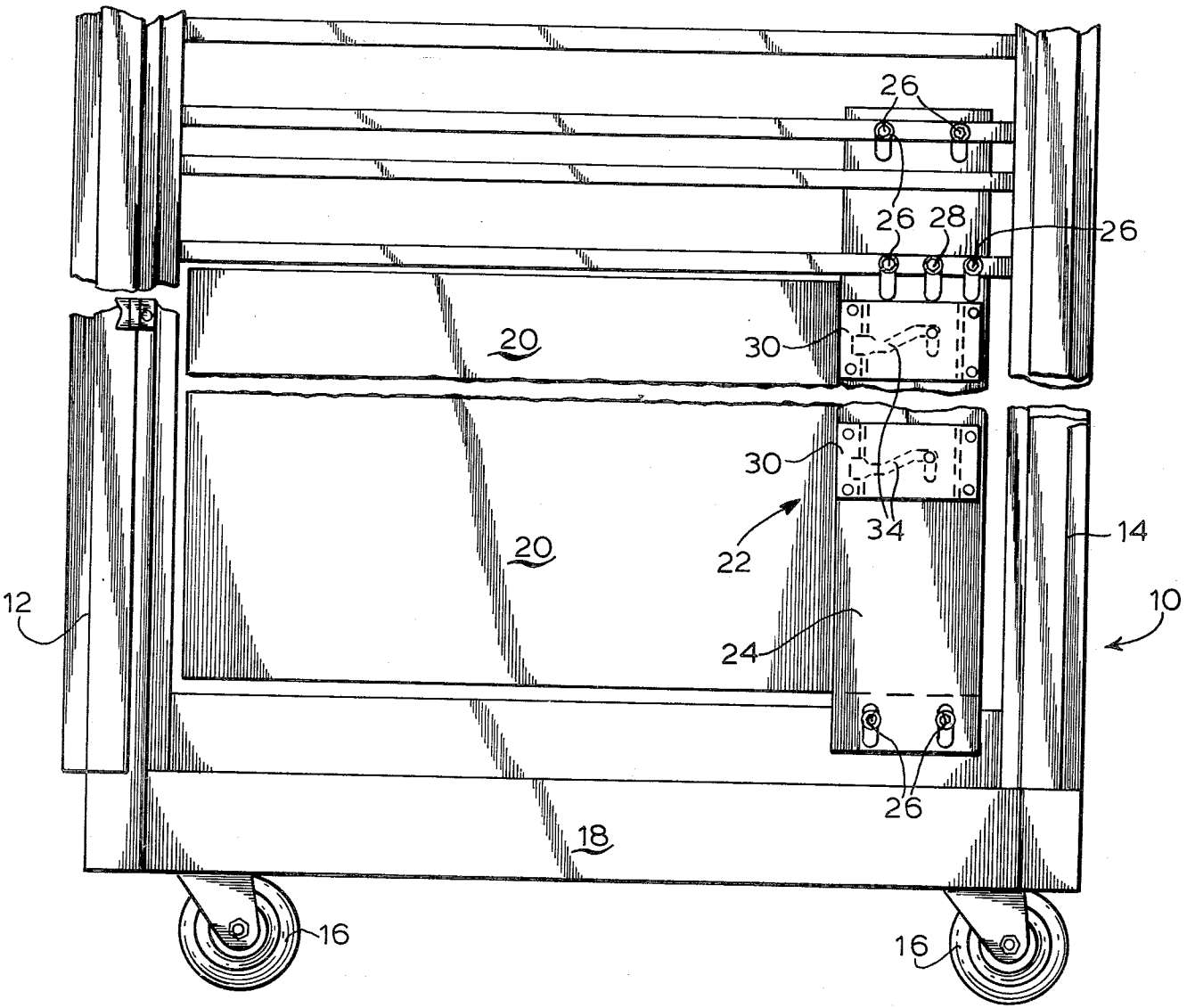
FIG. 1 is a partially sectional view of a cabinet having an interlocking mechanism incorporating the teachings of the present invention.

With regard now to the figures, there is shown a cabinet or supporting means 10 having a front and rear section 12 and 14 respectively, with the front section 12 having an opening provided to access the cabinet's interior by perhaps doors etc. The cabinet 10 is free standing and provided with casters 16 mounted on its bottom section 18, so as to allow it to freely roll about.

Maintained in the cabinet 10 are a plurality of vertical stacked units or disks 20, which are slidably supported by the cabinet by perhaps individual standard rack slides common in the industry. This allows the disks 20 to be slidably extended through the front of the cabinet. In typical applications four or more disk drives may be involved.

The interlock mechanism 22 includes a vertical slide member 24 which is slidably mounted to the cabinet 10 by way of bolts 26. While bolts 26 allow the slide member 24 to move vertically, a sufficient bearing should exist on the slide member 24, so that it moves only when a force is placed thereon, and not due to gravitational force. This may be accomplished by perhaps a tension controller or bolt 28, which may be adjusted to provide the degree of bearing on the slide member 24 desired.

Mounted on the slide member 24, is a plurality of capture brackets 30, with one for each of the disks 20 located in the cabinet 10. Of course, if one chose not to include certain disks within the operation of the interlock mechanism 22, the respective bracket would not be necessary (i.e., the bottom most disk or perhaps an empty shelf).

The capture bracket 30 shown most clearly in FIGS. 3–5, is U-shaped with legs 30*a* and *b*, and may be mounted on the slide member 24, by way of fasteners 32 as shown, or any other means desired so that vertical movement of the bracket 30 causes vertical movement of the slide member 24. A slot 34 having a curved portion 34*a* is provided in the bracket 30, and allows for the camming of the bracket 30 when engaged by a bearing member or pin 36 which is affixed to the respective disks 20 via fastening means 38.

The interaction of the pin 36 and bracket 30 can best be seen upon reference to FIGS. 1 and 3. In FIG. 1, the disks 20 are shown to be fully inserted in the cabinet 10, with pin 36 disposed in a vertical portion 34*b* of slot 34. This position is designated by the letter X in FIG. 3 and would correspond to the position of all the disks in the cabinet 10 when fully inserted therein.

Upon the withdrawal of a disk 20 from the cabinet 10, the pin 36 moves horizontally in the slot 34 to a position Y into engagement with the side of the slot 34. Further movement in this direction causes the pin to come against the bracket 30 at the curved portion 34*a*, pushing it upward along with the slide member 24, until the pin 36 passes out the slot 34 via an enlarged portion 34*c*, with the disk 20 being further withdrawn until it engages perhaps a stop in the front 12 of the cabinet 10.

Since all of the remaining disks 20 were at this time, fully within the cabinet 10, with their associate pins 36 in the X position, the upward movement of the slide member 24, and their respective brackets 30 causes the pins 36 to move into position Z with respect to their brackets 30. The slide member 24 will remain in this position due to tension controller 28, until it received further camming action thereon via pin 36 and bracket 30 engagement. This effectively prevents horizontal movement of the remaining disks 20 out of the cabinet 10, after one has been withdrawn.

When the withdrawn disk 20 is thereafter inserted back into the cabinet 10, the reverse to the aforenoted takes place, with the pins 36 of the respective disks returning to position X, at which time anyone of them may be withdrawn with similar events transpiring.

It might be noted that the length of the pin 36 need only be sufficient to enable it to engage the sides of slot 34 and should not be so long as to engage the flat position of leg 30*a*.

In addition, in certain applications if it were necessary to perhaps remove two or more disks for replacement purposes etc., this may be accomplished only upon the simultaneous withdrawal of the disks causing the respective pins to cooperatively engage the bracket and allow withdrawal of the disks.

As is evident, the device is not complex and relatively inexpensive while providing effectively for the desired results. Further, while a disk and cabinet arrangement has been specifically referred to herein by way of an example, it is considered to be by no means exclusive, with other applications readily apparent. The scope of the invention should not be limited thereby, rather its scope should be determined by that of the appended claims.

What is claimed is:

1. An interlock mechanism for use with a plurality of vertically stacked units each unit capable of being horizontally movable into and out of the stack, with said mechanism comprising:

pin means maintained on each unit respectively and movable therewith;

slide means which includes respective slot means having respective camming surfaces engageable with the respective pin means upon movement of the respective units in and out of the stack with said engagement causing the slide means to move vertically between a first position and a second position;

said slide means having means which allows a unit to be withdrawn from the stack when in said first position with the withdrawing therefrom causing the pin means of the unit withdrawn to engage the respective slot means on the slide means moving the slide means from the first position to the second position;

said slide means capable of preventing the units remaining in the stack from being horizontally withdrawn from the stack when in said second position; and insertion of the withdrawn unit into the stack causes the pin means of said unit to engage the slot means moving the slide means from the second position to the first position.

2. The invention in accordance with claim 1 wherein said slot means includes a vertically extending portion with respect to the camming surface and the pin means are disposed in this portion when the slide means is in its second position preventing horizontal movement of the unit.

3. The invention in accordance with claims 1 or 2 wherein said slide means comprises an elongated member having capture brackets affixed thereto with said slot means disposed on said bracket, and said member is slidably supported adjacent the stack of units.

4. The invention in accordance with claim 3 which further includes a tension controller capable of adjusting the slidability of the slide means.

5. The invention in accordance with claim 3 which includes a cabinet which supports said stacked units, and said stacked units are disk drives slidably mounted in said cabinet.

* * * * *